US010553978B2

(12) United States Patent
Juelich et al.

(10) Patent No.: US 10,553,978 B2
(45) Date of Patent: Feb. 4, 2020

(54) CONTACTING DEVICE FOR CONTACTING AN ELECTRICAL CONDUCTOR TO AN ELECTRICAL CONDUCTOR PATH

(71) Applicant: EATON INTELLIGENT POWER LIMITED, Dublin (IE)

(72) Inventors: Anke Juelich, Niederkassel (DE); Klaus Dauer, Koblenz (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/771,104

(22) PCT Filed: Oct. 25, 2016

(86) PCT No.: PCT/EP2016/075609

§ 371 (c)(1),
(2) Date: Apr. 27, 2018

(87) PCT Pub. No.: WO2017/072092

PCT Pub. Date: May 4, 2017

(65) Prior Publication Data

US 2018/0331449 A1 Nov. 15, 2018

(30) Foreign Application Priority Data

Oct. 30, 2015 (DE) ..... 10 2015 118 574

(51) Int. Cl.

| | |
|---|---|
| ***H01R 4/24*** | (2018.01) |
| ***H01R 13/193*** | (2006.01) |
| ***H01R 4/48*** | (2006.01) |

(52) U.S. Cl.
CPC ..... *H01R 13/193* (2013.01); *H01R 4/4836* (2013.01)

(58) Field of Classification Search
CPC ... H01R 13/193; H01R 4/4836; H01R 4/4827
(Continued)

(56) References Cited

U.S. PATENT DOCUMENTS 4,437,720 A * 3/1984 Harbauer ..... H01R 4/4827 439/435
2007/0099479 A1* 5/2007 Holterhoff ..... H01R 4/4836 439/441

FOREIGN PATENT DOCUMENTS

DE 3237787 C1 3/1984
DE 3044133 A1 6/1985
(Continued)

*Primary Examiner* — Jean F Duverne
(74) *Attorney, Agent, or Firm* — Leydig, Voit & Mayer, Ltd.

(57) ABSTRACT

A contacting device for contacting an electrical conductor to an electrical conductor track includes a housing having openings for inserting the conductor and the conductor track into a cavity. A contact clip is in the cavity, and is a single element that includes a first portion having an end to press the conductor onto the conductor track, and a second portion from which a protrusion protrudes. The contact clip is bent in the cavity so that the first portion is under bending stress and the end of the first portion is pressed against the protrusion. The second portion is arranged in the housing such that it and the protrusion are displaced when a force acts on the second portion, as a result of which the end of the first portion is released from abutting the protrusion and is pressed against the conductor to hold the conductor on the conductor track.

10 Claims, 13 Drawing Sheets

(58) Field of Classification Search
USPC ..... 439/441
See application file for complete search history.

(56) References Cited

FOREIGN PATENT DOCUMENTS

| | | | |
|---|---|---|---|
| DE | 20300266 | U1 | 5/2004 |
| DE | 102004001202 | A1 | 7/2004 |
| DE | 202006009460 | U1 | 3/2007 |
| DE | 202011051466 | U1 | 11/2011 |
| DE | 102010054679 | A1 | 6/2012 |
| DE | 202014103797 | U1 | 11/2014 |
| EP | 0052766 | A1 | 6/1982 |
| EP | 1555723 | A1 | 7/2005 |
| EP | 2768079 | A1 | 8/2014 |
| WO | WO 2015159002 | A1 | 10/2015 |

* cited by examiner

CONTACTING DEVICE FOR CONTACTING AN ELECTRICAL CONDUCTOR TO AN ELECTRICAL CONDUCTOR PATH

CROSS-REFERENCE TO PRIOR APPLICATIONS

This application is a U.S. National Stage Application under 35 U.S.C. § 371 of International Application No. PCT/EP2016/075609 filed on Oct. 25, 2016, and claims benefit to German Patent Application No. DE 10 2015 118 574.1 filed on Oct. 30, 2015. The International Application was published in German on May 4, 2017 as WO 2017/072092 A1 under PCT Article 21(2).

FIELD

The invention relates to a contacting device for contacting an electrical conductor to an electrical conductor track, the electrical conductor being connected to the electrical conductor track by means of insertion terminal technology.

BACKGROUND

A contacting device used to contact an electrical conductor to an electrical conductor track, for example a busbar, by means of insertion terminal technology typically comprises a contact clip that is located within a cavity in a housing and comprises at least one spring-loaded leg. By means of the spring-loaded leg of the contact clip, an electrical conductor is pressed against the electrical conductor track or busbar and secured thereon in a press fit when inserted into the cavity inside the housing of the contacting device. The contact clip is arranged in the cavity of the housing in the insertion path via which the electrical conductor is inserted into the contacting device.

If the electrical conductor is inserted in the cavity in contacting device, the spring-loaded leg of the contact clip has to be deflected out of its starting position by the electrical conductor counter to the restoring force of the contact clip in order to secure the electrical conductor in the press fit owing to the restoring force of the spring-loaded leg of the contact clip. When the electrical conductor is inserted into the cavity inside the contacting device, a force has to be applied to overcome the restoring force of the spring-loaded leg of the contact clip. In a conventional insertion terminal, a stripped cable has to be inserted into the contacting device using an amount of force greater than the restoring force of the spring-loaded leg of the contact clip. A contacting device for producing an AC busbar connection by means of insertion terminal technology has to be able to withstand large plugging forces when the electrical conductor is inserted.

SUMMARY

According to an aspect of the present invention, an embodiment provides a contacting device for contacting an electrical conductor to an electrical conductor track. The contacting device includes a housing having a first opening suitable for inserting the electrical conductor into a cavity inside the housing, and a second opening suitable for inserting the electrical conductor track into the cavity inside the housing. The contacting device also including a contact clip arranged in the cavity inside the housing. The contact clip is a single element that includes a first portion having an end configured to press the electrical conductor onto the electrical conductor track, and a second portion from which a material protrusion of the contact clip protrudes. The material protrusion is integrated in the second portion. The contact clip is configured to be bent in the cavity in such a way that the first portion is under bending stress and the end of the first portion of the contact clip is pressed against the material protrusion by the bending stress. The second portion of the contact clip is arranged below the first opening in the housing perpendicularly to the longitudinal direction of the first opening and in parallel with a bottom surface of the cavity. The second portion of the contact clip is movably arranged in the housing such that the second portion of the contact clip and the material protrusion are displaced when a force acts on the second portion of the contact clip, as a result of which the end of the first portion of the contact clip is released from abutting the material protrusion and is pressed against the electrical conductor owing to the bending stress on the first portion of the contact clip in such a way that the electrical conductor is held on the electrical conductor track in a press fit when the electrical conductor is inserted into the contacting device through the first opening and the electrical conductor track is inserted into the contacting device through the second opening.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

One issue dealt with in the present invention is to specify a contacting device for contacting an electrical conductor to an electrical conductor track in which a small amount of force is required to secure the electrical conductor in the contacting device and thus to contact the electrical conductor to the electrical conductor track.

An advantage of embodiments of the invention is that a contacting device is provided for contacting an electrical conductor to an electrical conductor track in which only a small amount of force is required to contact the electrical conductor to an electrical conductor track.

Inside the housing of the contacting device according to embodiments of the invention, the contacting device includes a contact clip having a first portion and a second portion. The first portion of the contact clip is under bending stress and includes an end by which the electrical conductor can be secured to the electrical conductor track in a press fit. The contact clip is shaped such that, before the electrical conductor is inserted into a cavity inside the contacting device, the end of the first portion of the contact clip abuts a material protrusion that protrudes from the second portion of the contact clip.

The contact clip can be movably arranged in the cavity inside the housing of the contacting device such that the electrical conductor is pressed against the second portion of the contact clip when inserted into the cavity inside the contacting device, as a result of which the second portion of the contact clip and the material protrusion are displaced such that the end of the first portion of the contact clip is released from abutting the material protrusion and is pressed against the conductor owing to the bending stress on the contact clip in such a way that the conductor is held on the conductor track in a press fit.

The contact clip, which is latched to the material protrusion when in its starting position before the electrical conductor is inserted into the cavity inside the contacting device, can be inserted into all terminal blocks and electrical switchgear, which can now be provided even in the open state for connecting an electrical conductor to an electrical conductor track or busbar. The contact clip is designed as a clamping spring, it being possible to use a single element to ensure that the spring-loaded leg of the contact clip is latched to the material protrusion when in the starting state and to ensure that the electrical conductor is secured to the electrical conductor track.

Figure 1A:
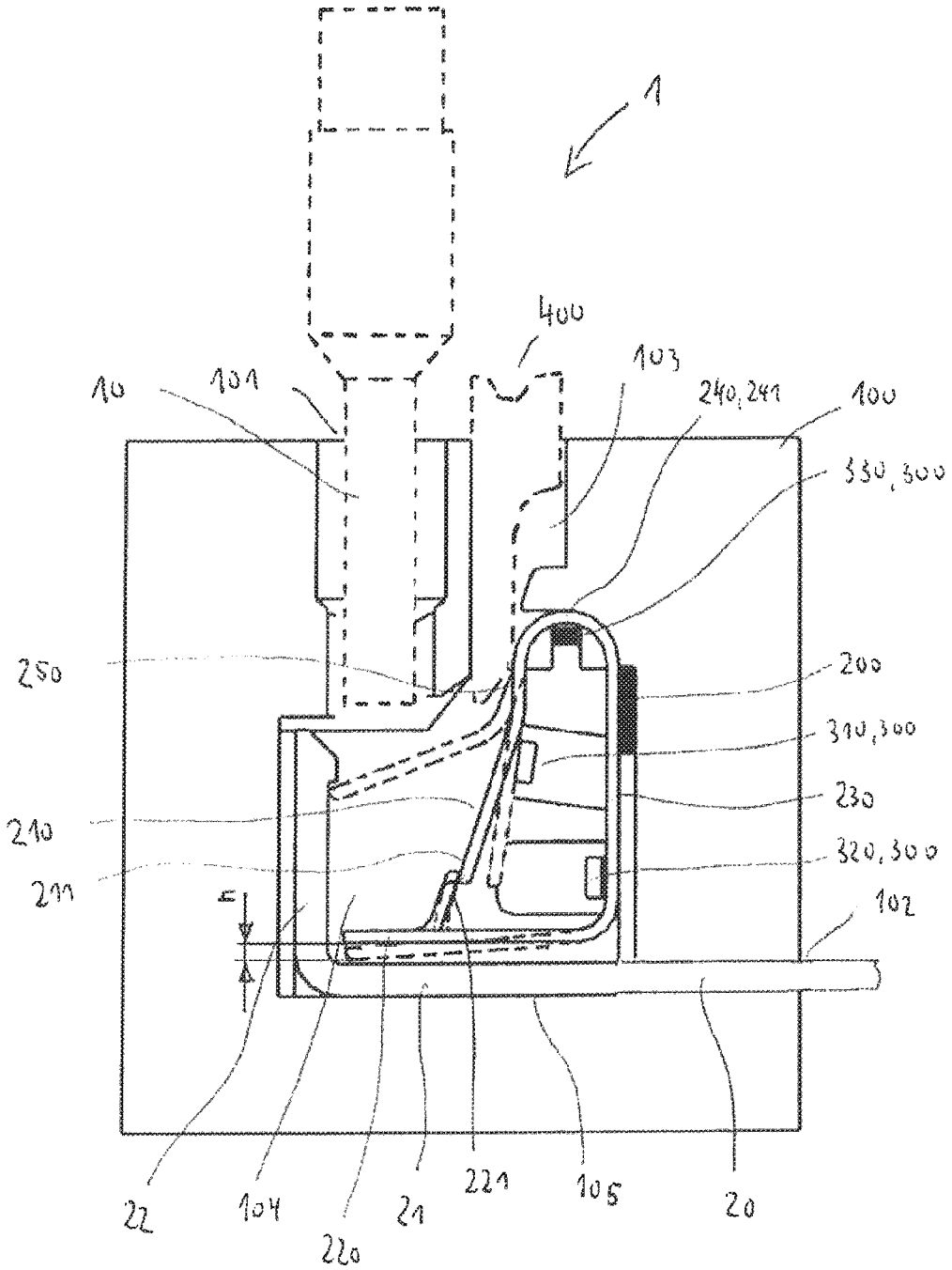
FIG. 1A is a schematic view of a first embodiment of a contacting device for contacting an electrical conductor to an electrical conductor track.
Figure 1B:
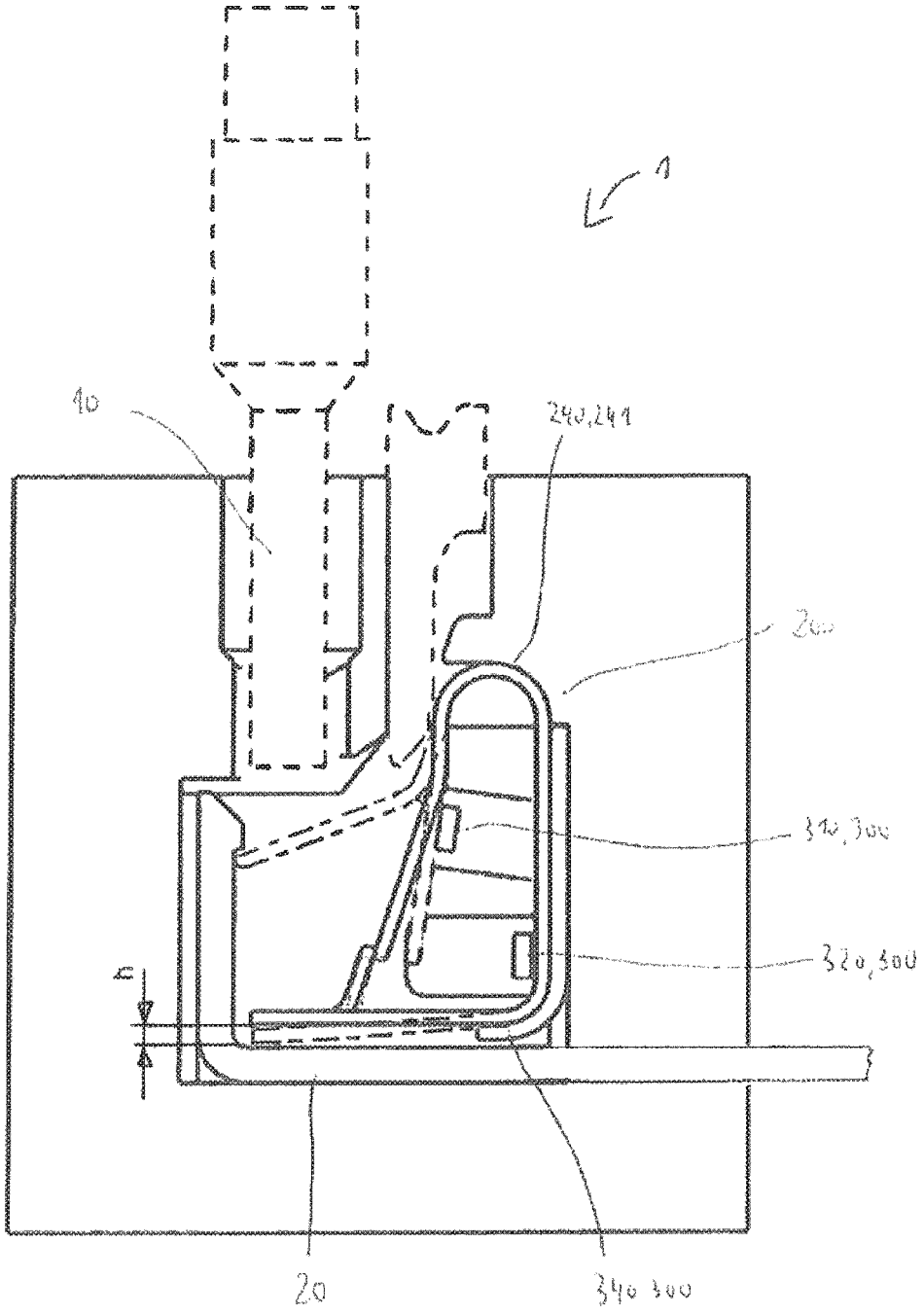
FIG. 1B is a schematic view of a second embodiment of a contacting device for contacting an electrical conductor to an electrical conductor track.

FIGS. 1A and 1B are both schematic views of a contacting device 1 for contacting an electrical conductor 10 to an electrical conductor track 20 in which only a small amount of force is required in order to secure the electrical conductor to the electrical conductor track when inserting the electrical conductor into the contacting device. The contacting device 1 comprises a housing 100 having a first opening 101 suitable for inserting the electrical conductor 10 into a cavity 104 inside the housing, and a second opening 102 suitable for inserting the electrical conductor track 20 into the cavity 104 inside the housing. The electrical conductor track can, for example, be a busbar by which an electrical signal can be applied to an electrical apparatus, for example a relay or a miniature circuit breaker. The contacting device 1 comprises a contact clip 200 arranged in the cavity 104 inside the housing 100. The contact clip 200 comprises a first portion 210 having an end 211 for pressing the conductor 10 onto the electrical conductor track 20. In addition, the contact clip 200 comprises a second portion 220 from which a material protrusion 221 of the contact clip protrudes.

The contact clip 200 is bent in the cavity 104 inside the housing in such a way that the first portion 210 is under bending stress and is thus formed as a spring-loaded leg. Owing to the bending stress, the end 211 of the first portion 210 of the contact clip is pressed against the material protrusion 211 when in a starting state before the electrical conductor 10 is inserted into the cavity 104. In the starting state, the contact clip 200 is thus in a state latched to the material protrusion 211.

The second portion 220 of the contact clip 200 is arranged in the cavity 104 below the first opening 101 in the housing and above the bottom surface 105 of the cavity 104, and so the conductor is pushed against the second portion 220 of the contact clip in the longitudinal direction of the first opening 101 when inserted into the cavity 104 through the first opening 101 in the housing 100. The second portion 220 of the contact clip 200 is movably arranged in the housing 100 such that the second portion 220 of the contact clip and the material protrusion 221 are displaced toward the bottom surface of the cavity when the conductor 10 is pressed against the second portion 220 of the contact clip 200. The second portion 220 of the contact clip is arranged in a spring-loaded manner at a spacing above the conductor track 20 or bottom surface 105 of the cavity inside the housing in such a way as to yield when pressed by the end of the electrical conductor 10, for example a wire end ferrule, and to be deflected toward the bottom 105 of the cavity 104. As a result, the material protrusion 221 is also pressed downward and the end 211 of the first portion 210 of the contact clip unlatches or releases from the latched position.

FIG. 1 shows the maximum travel h for unlatching the end 211 of the first portion 210 of the contact clip that is latched to the material protrusion 221.

By displacing the portion 220 toward the portion of the electrical conductor track arranged therebelow, the end 211 of the first portion 210 of the contact clip 200 is released from abutting the material protrusion 221 and is pressed against the conductor 10 owing to the bending stress on the first portion 210 of the contact clip 200 in such a way that the conductor 10 is held on the conductor track 20 in a press fit.

In the cavity 104 inside the housing 100, the contacting device 1 comprises a guide element 300 along which the contact clip 200 is guided. In this case, the guide element 300 is designed such that the first portion 210 of the contact clip 200 is under the bending stress. Owing to the bending stress, the end 211 of the first portion 210 of the contact clip is pressed against the material protrusion 221 when in the starting state. The guide element 300 can comprise various functional components.

For example, the guide element 300 according to one embodiment can comprise a stop 310 for limiting a movement of the first portion 210 of the contact clip 200 between the stop 310 and the material protrusion 221. The stop 310 of the guide element 300 is arranged in the cavity 104 in such a position that the bending stress on the first portion 210 of the contact clip is greater when the first portion 210 of the contact clip abuts the stop 310 than when it abuts the material protrusion 221 on the contact clip. The stop 310 can be arranged in the cavity 104 at a small distance behind the material protrusion 221.

The second portion 220 of the contact clip 200 is arranged in the housing 100 substantially perpendicularly to the longitudinal direction of the first opening 101 and can in particular be arranged in parallel with the bottom surface 105 of the cavity 104. The contact clip 200 comprises a third portion 230 that is arranged in the housing 100 substantially perpendicularly to the second portion 220 of the contact clip 200. For this purpose, the contact clip is bent by approximately 90° between the second portion 220 and the third portion 230. According to another embodiment, the guide element 300 can comprise a first contact surface 320 which the third portion 230 of the contact clip 200 abuts.

The contact clip 200 comprises a fourth portion 240 adjoining the third portion 230. The fourth portion 240 has a bent region 241 at which the contact clip is bent in an almost semicircular manner. According to a possible embodiment of the contacting device as shown in FIG. 1A, the guide element 300 can comprise a second contact surface 330 on which the bent region 241 of the fourth portion 240 of the contact clip rests.

A fifth portion 250, which extends almost in parallel with the third portion 230 of the contact clip, adjoins the fourth portion 240 of the contact clip. The first portion 210 of the contact clip adjoins the fifth portion 250 and is bent toward the material protrusion 221 starting from the fifth portion 250 of the contact clip.

Unlike in the embodiment shown in FIG. 1A, in the embodiment of the contacting device 1 shown in FIG. 1B the guide element 300 comprises a bearing surface 340 on which the second portion 220 of the contact clip rests. The bearing surface 340 of the guide element 300 is arranged on an end of the second portion 220 of the contact clip at which the second portion 220 of the contact clip merges into the third portion 230 of the contact clip.

Furthermore, the second contact surface 330 of the guide element 300 can be omitted from both embodiments shown in FIGS. 1A and 1B. As a result, the first portion 210 of the contact clip has a greater spring action. The resultant extension to the length of the clamping lever of the contact clip 200 provides the contact clip, in particular the first portion 210 of the contact clip, with better resilience than when the bent region 241 of the fourth portion 240 of the contact clip abuts the second contact surface 330.

The material protrusion 221 can be designed as a lug for latching the end 211 of the first portion 210 of the contact clip 200. In this case, the lug is bent out of a plane of the second portion 220 of the contact clip. The lug can, for example, be formed as a rectangular material web cut out of the second portion 220 of the contact clip on all side edges but left connected to the second portion 220 of the contact clip on just one side edge. At this connected side edge, the material protrusion 221 is bent upward out of the plane of the second portion 220 of the contact clip. This is shown by way of example in FIG. 3B.

The contacting device 1 comprises an actuation element 400 for moving the first portion 210 of the contact clip into various positions. The precise function of the actuation element 400 will be described in more detail below in the description of FIG. 3A to 8. Alternatively, the actuation element 400 can be omitted, as in FIG. 1C. If the contact clip 200 needs to be actuated, the actuation element can be replaced by an appropriate tool 410 of a suitable size to be inserted into the gap in front of the bent region of the contact clip 241, such as a screwdriver, a mains test screwdriver or the like.

Like in the embodiments in FIGS. 1A and 1B, the electrical conductor track 20 comprises a first portion 21 and a second portion 22. The first portion 21 of the electrical conductor track 20 is arranged in parallel with the second portion 220 of the contact clip in the cavity 104 inside the housing of the contacting device and extends, for example, on the bottom surface of the cavity 104. The second portion 22 of the electrical conductor track 20 adjoins the first portion 21 and extends perpendicularly to the first portion 21 of the electrical conductor track 20 in the cavity 104 inside the housing of the contacting device. The second portion 22 can comprise a protrusion 23, the function of which will be described in more detail in the description of FIGS. 7A and 7B.

Figure 2A:
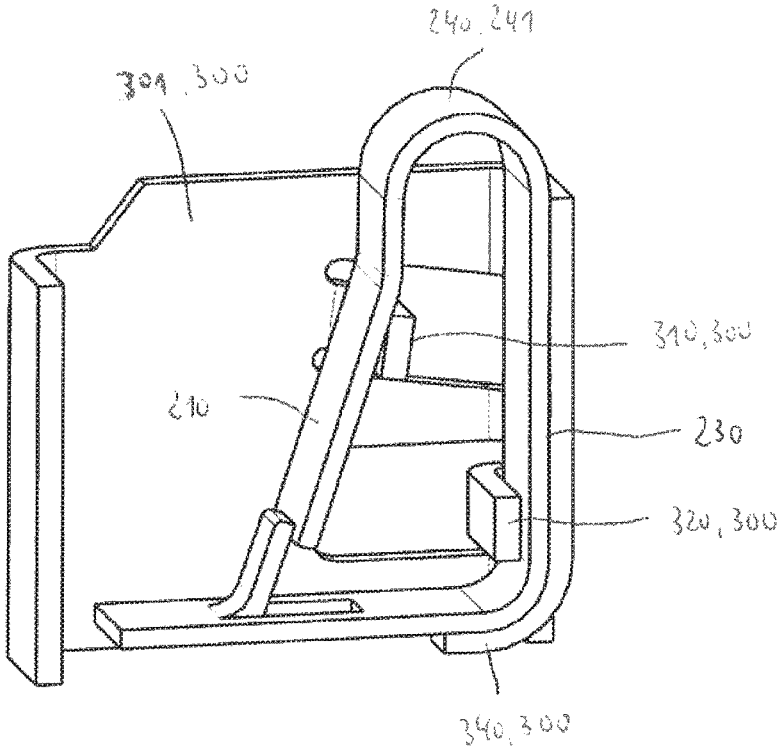
FIG. 2A shows a first embodiment of a guide element for guiding and shaping the contact clip.
Figure 2B:
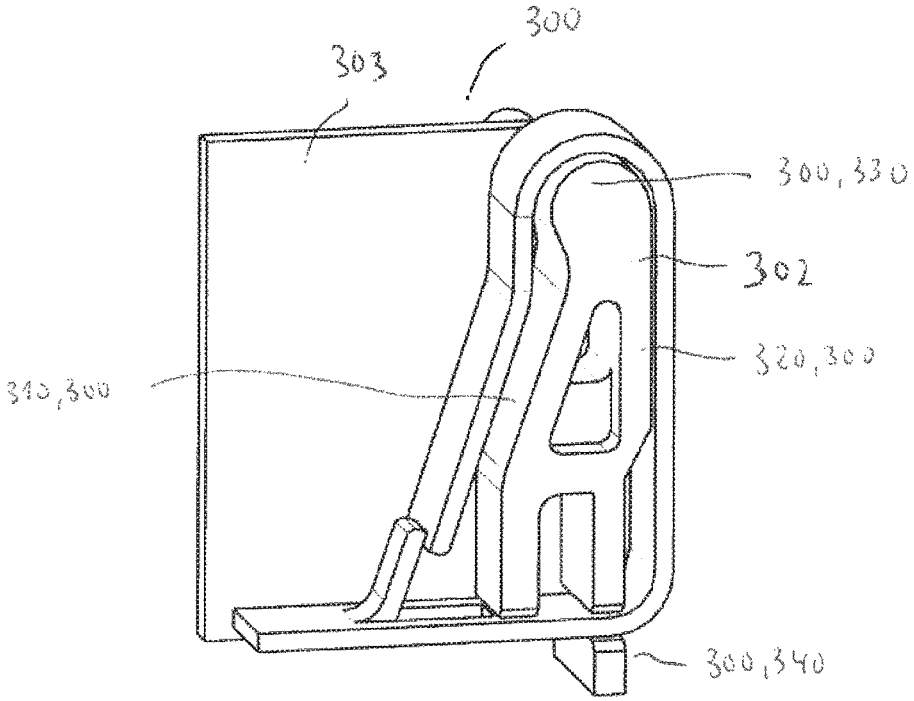
FIG. 2B shows a second embodiment of a guide element for guiding and shaping the contact clip.
Figure 2C:
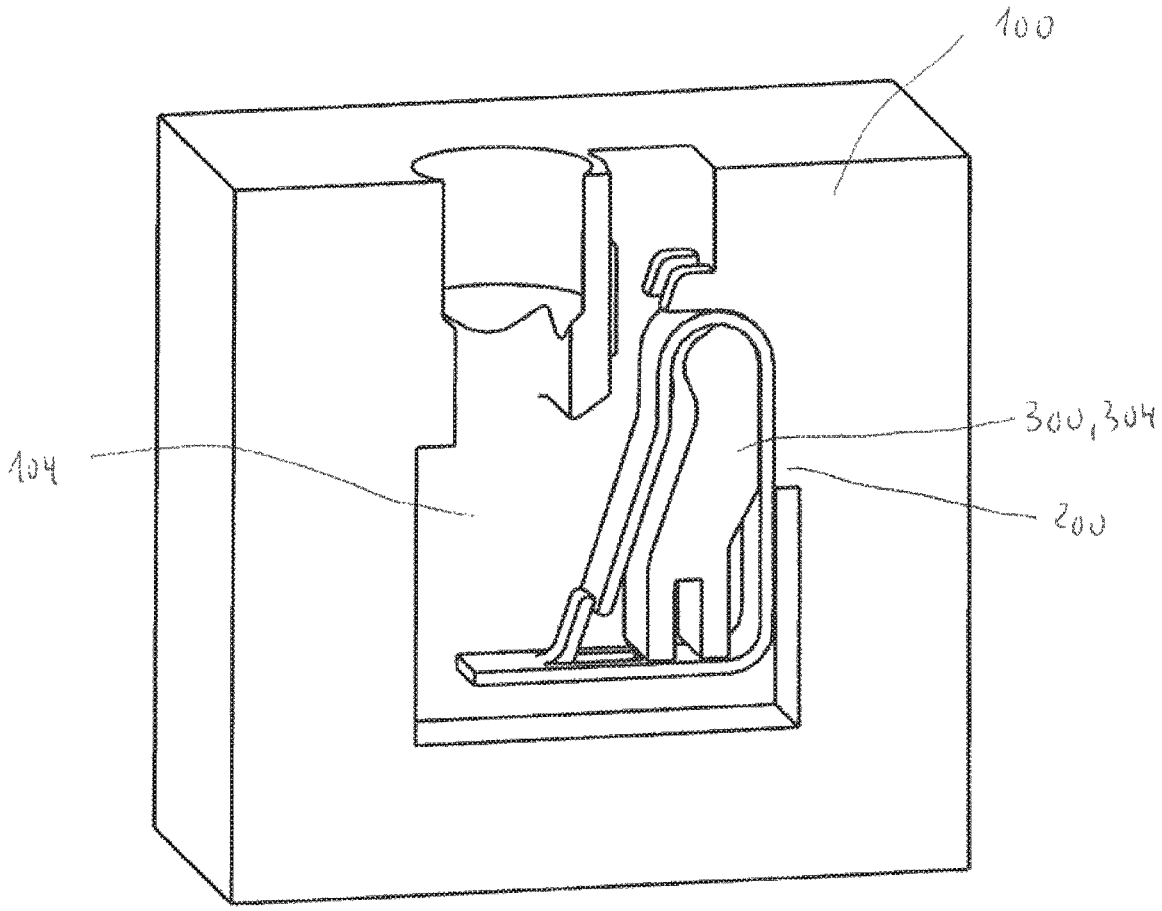
FIG. 2C is a schematic view of an embodiment of a contacting device having a third embodiment of a guide element.

FIG. 2A to 2C show various embodiments of the guide element 300. According to FIG. 2A, the guide element 300 can comprise a metal frame 301. The stop 310 is formed on the metal frame structure as a protrusion having a bent stop face on which the first portion 210 of the contact clip rests. The first portion 320 is formed as a bent protrusion on the frame 301. The third portion 230 of the contact clip 200 is guided between the first contact surface 320 and a wall of the frame structure 301. At its lower end, the wall comprises a bent portion, which forms the bearing surface 340 on which the part of the second portion 220 of the contact clip merging into the third portion 230 rests. The guide element, comprising the frame structure 301, the stop 310 attached thereto, the contact surface 320 and the bearing surface 340, is arranged within the cavity 104 inside the housing.

According to the embodiment shown in FIG. 2B, the guide element 300 is formed as a part support. The guide element 300 comprises a mount 303 in the form of a rear wall. A shaping element 302 is mounted on the wall 303. The contact clip 200 is guided along the contour of the shaping element. The guide element, comprising the mount 303 and the shaping element 302, is arranged within the cavity 104 inside the housing.

FIG. 2C shows another possible embodiment of the guide element 300. The guide element 300 is shaped by the material of the housing 100 of the contacting device and comprises a shaping element 302. The shaping element 302 is arranged within the cavity 104 and is shaped out of a contour of the housing.

The principle of operation of the contacting device for contacting the electrical conductor 10 to the electrical conductor track 20 will be illustrated below on the basis of FIG. 3A to 8. FIGS. 3A, 4, 5, 6, 7A and 8 show simplified embodiments of the contacting device 1 in various states before, during and after the electrical conductor 10 is inserted into the cavity 104 inside the contacting device, as well as after the electrical conductor has been removed from the contacting device.

In the embodiments of the contacting device in FIGS. 3A, 4, 5, 6, 7A and 8, the guide element 300 is arranged, by way of example and similarly to the embodiment shown in FIG. 2C, as a single material block arranged in the cavity 104 inside the housing 100 of the contacting device, or as a contour in the cavity 104 inside the housing 100. The contact clip 200 is designed as an insertion terminal spring and is guided along the guide element 300.

The contact clip is fitted in a clamped manner in a defined region in the cavity inside the housing 100. This ensures that the spring forces of both the first portion 210, formed as the spring leg, and the second portion 220 of the contact clip are guaranteed for their respective functions.

Figure 3A:
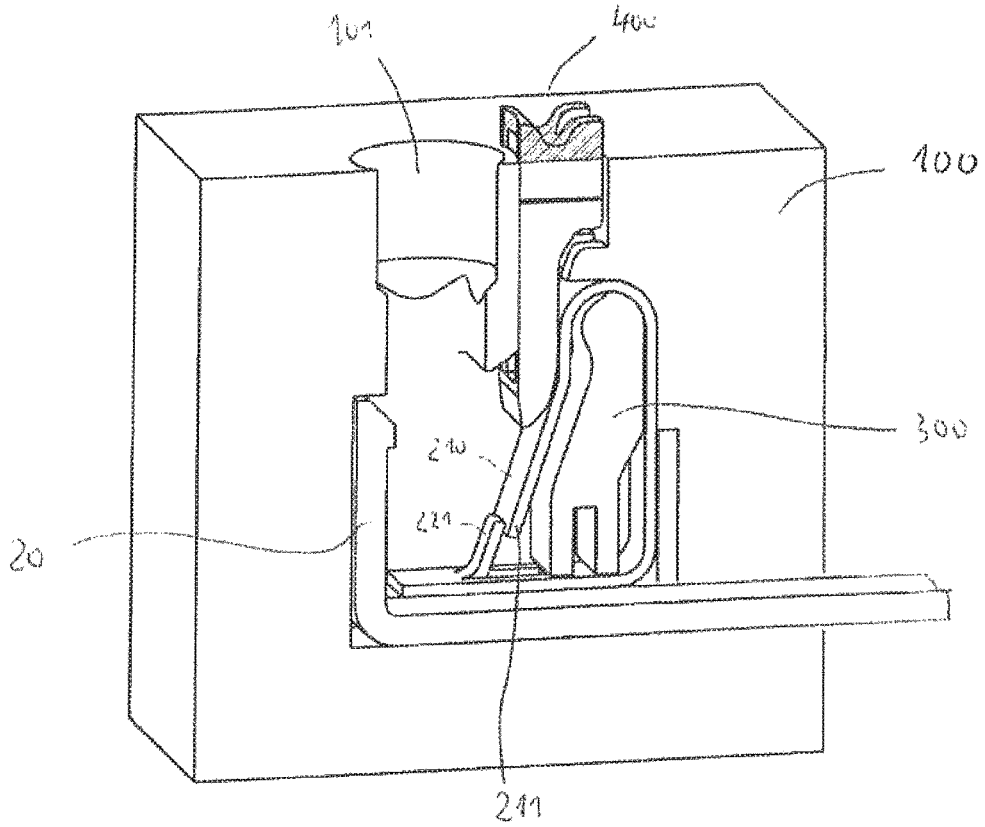
FIG. 3A is a simplified view of an embodiment of a contacting device for contacting an electrical conductor to an electrical conductor track before the electrical conductor is inserted into the contacting device.
Figure 3B:
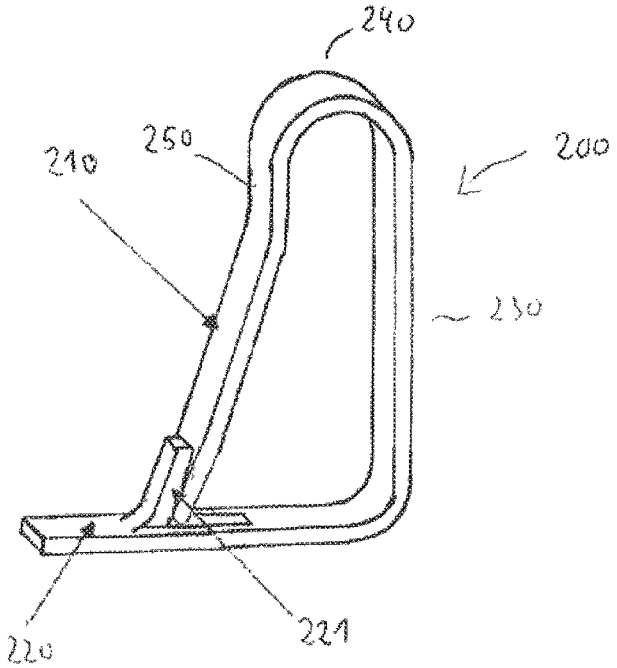
FIG. 3B shows a contact clip of a contacting device for contacting an electrical conductor to an electrical conductor track in a latched starting state.

FIGS. 3A and 3B show a starting position in which the contact clip is latched to the material protrusion 221 formed as a detent lug. The material protrusion or detent lug 221 is integrated in the second portion 220 of the contact clip. As shown in FIGS. 3A and 3B, the first portion 210 of the contact clip is pretensioned on the material protrusion 221 when the contact clip is in a starting position, and is thus held in a stable latched position before the electrical conductor 10 is inserted through the first opening 101 in the cavity 104 inside the housing 100 of the contacting device. In the starting state before the electrical conductor 10 is inserted into the cavity 104, the contacting device is in an open state since the contact clip is not located in the insertion path of the electrical conductor.

The length of the first portion 210 of the contact clip should be selected such as to ensure that the contact clip 200 is securely held on the material protrusion when in the starting position. Unlike the embodiment of the contact clip shown in FIG. 3A, FIG. 3B shows an embodiment in which the first portion 210 is longer. The first portion 210 of the contact clip can be extended in the region of the material protrusion 221, for example up to the second portion 220 of the contact clip.

In the embodiments of the contacting device 1 shown in FIG. 3A to 9B, the actuation element 400 comprises different markings. The status or visibility of these markings allows the position of the contact clip 200 at that moment within the housing to be seen from the outside. When the contact clip is in the starting position shown in FIGS. 3A and 3B, the actuation element 400 is arranged in its lowest position in the third opening 103 in the housing. The end of the actuation element 400 rests on the spring-loaded first portion 210 of the contact clip 200. Only the crosshatched marking on the actuation element 400 protrudes from the third opening 103 in the housing. The crosshatched region of the marking ends at the top edge of the housing and shows an operator that the contact clip 200 is in the latched starting position.

Figure 4:
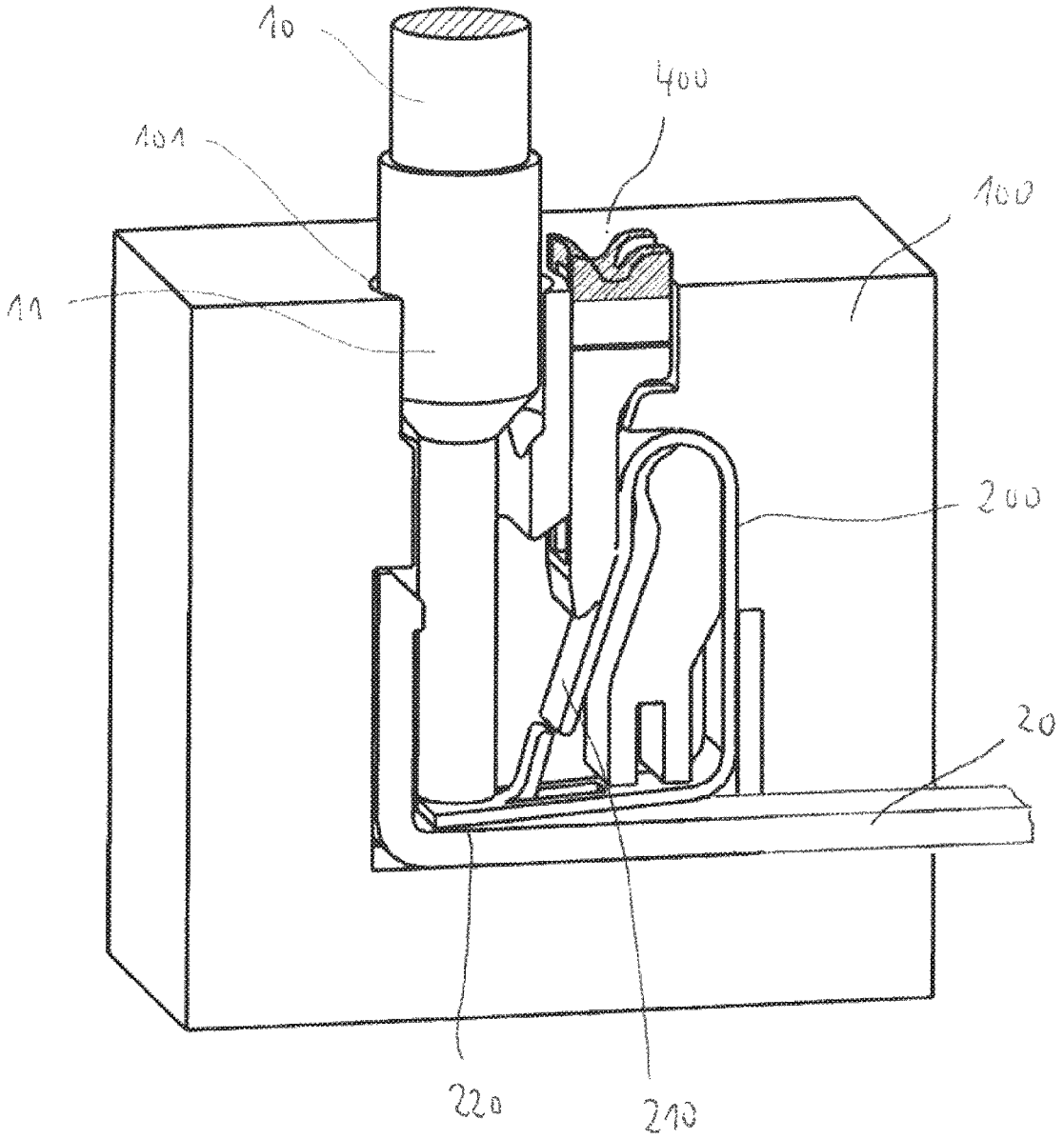
FIG. 4 is a simplified view of a contacting device for contacting an electrical conductor to an electrical conductor track when a spring-loaded leg of the contact clip is released from the latched starting position.

FIG. 4 shows the state of the contacting device 1 when the electrical conductor 10 is inserted into the first opening 101 in the housing of the contacting device. The electrical conductor 10 can comprise a wire end ferrule 11 at its end. Owing to the latched position of the contact clip, the first portion 210 of the contact clip is not located in the insertion path of the electrical conductor 10, and so the conductor 10 cannot be inserted into the cavity 104 inside the contacting device without a relatively high amount of force.

When the end of the electrical conductor 10 or the wire end ferrule 11 is inserted into the cavity 104 inside the housing, the end of the second portion 220 of the contact clip 200 is pushed downward toward the portion 21 of the electrical conductor 20. As a result of the second portion 220 of the contact clip formed as the spring leg being pushed down, the material protrusion 221 is lowered and the first portion 210 of the contact clip, which is also formed as a spring leg, is released from the latched position, in which it abuts the material protrusion 221.

Figure 5A:
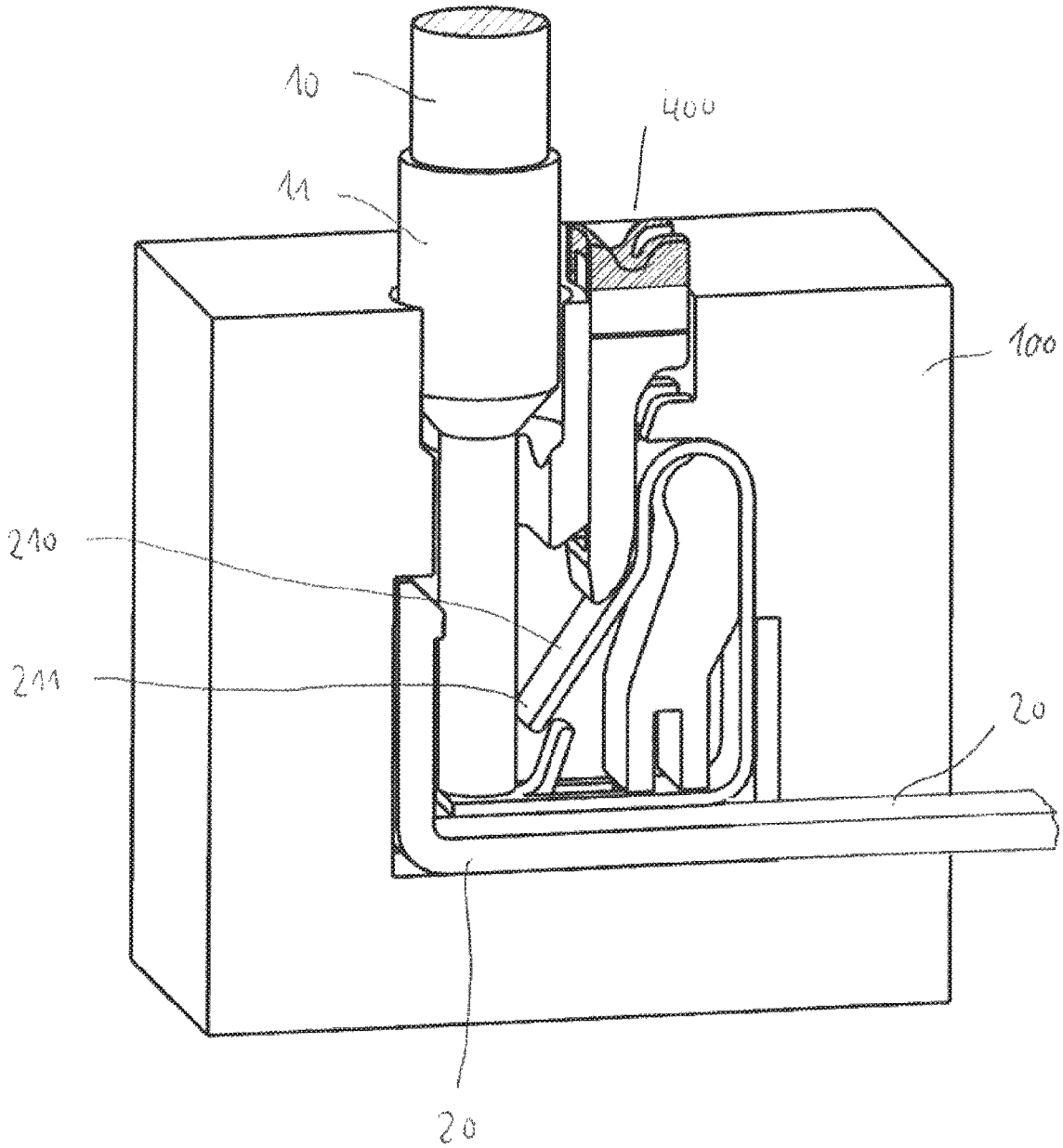
FIG. 5A is a simplified view of a contacting device for contacting an electrical conductor to an electrical conductor track together with an electrical conductor of a large conductor cross section held in a press fit.
Figure 5B:
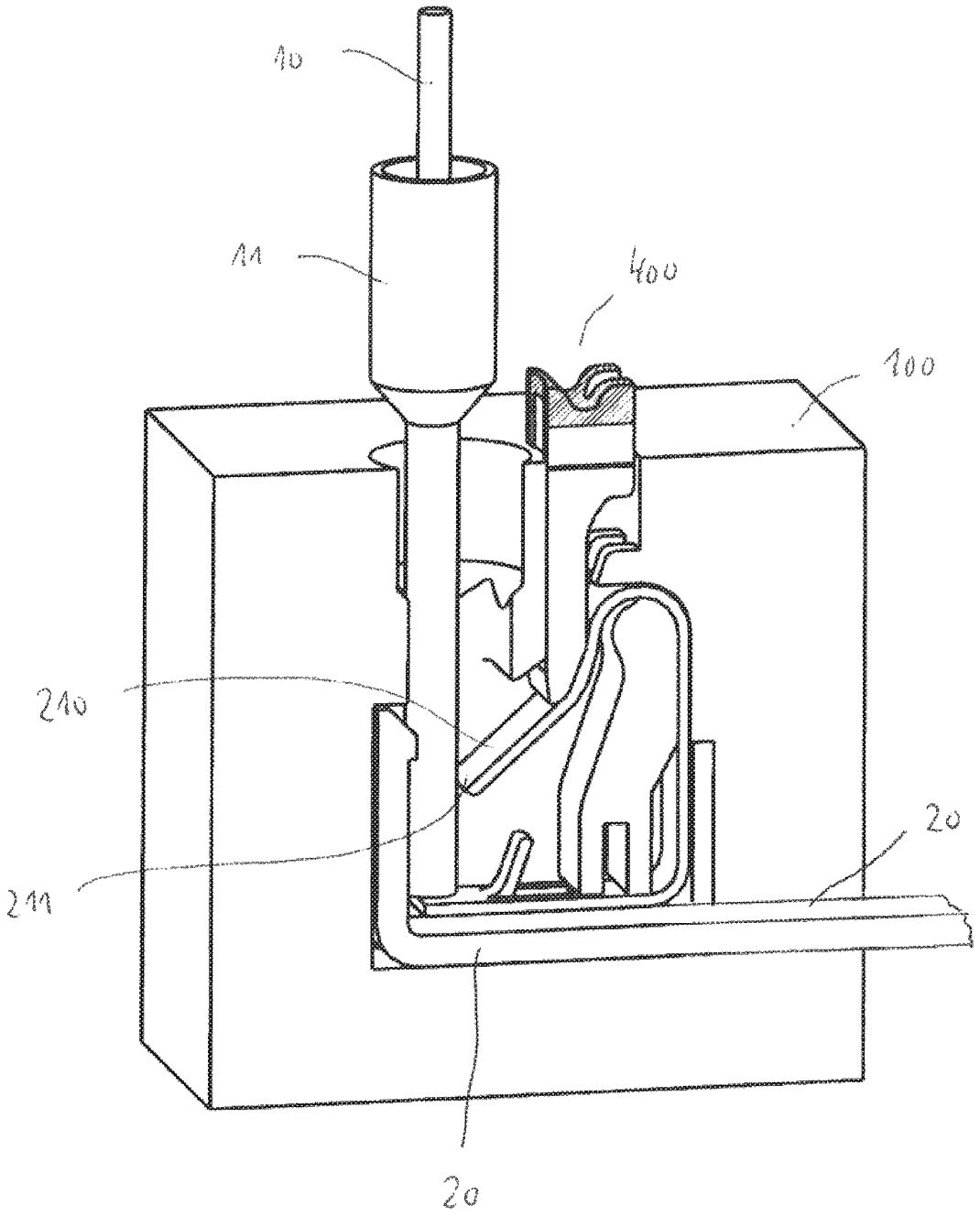
FIG. 5B is a simplified view of a contacting device for contacting an electrical conductor to an electrical conductor track together with an electrical conductor of a small conductor cross section held in a press fit.

As a result, the end 211 of the first portion 210 of the contact clip 200 moves toward the first opening 101 until the end 211 of the spring leg 210 abuts the electrical conductor 10 or wire end ferrule 11. Owing to the spring force of the spring leg 210, the conductor end is pressed onto the electrical conductor track 20. FIGS. 5A and 5B show electrical conductors 10 of different diameters held on the electrical conductor track 20 in a press fit by means of the end 211 of the first portion 210 of the contact clip 200. The actuation element 400 is raised by the spring leg 210 in the third opening 103 in the housing 100 and is guided into a corresponding position. When the actuation element 400 is in the position shown in FIG. 5A, the clear region below the crosshatched marking is visible. When the actuation element is in the position shown in FIG. 5B, the clear region below the crosshatching is no longer visible. The two positions of the actuation element show an operator that the electrical conductor is in a press fit by means of the terminal clamp 200.

To press down the second portion 220 of the contact clip, a significantly lower amount of force is required compared with embodiments of the contacting device in which the spring-loaded leg 210 of the contact clip is arranged in the insertion path of the electrical conductor 10 and only has to be pushed sideways counter to its restoring force by the insertion force acting on the conductor from the outside. Therefore, less force is required to secure the electrical conductor 10 to the conductor track 20.

Figure 1C:
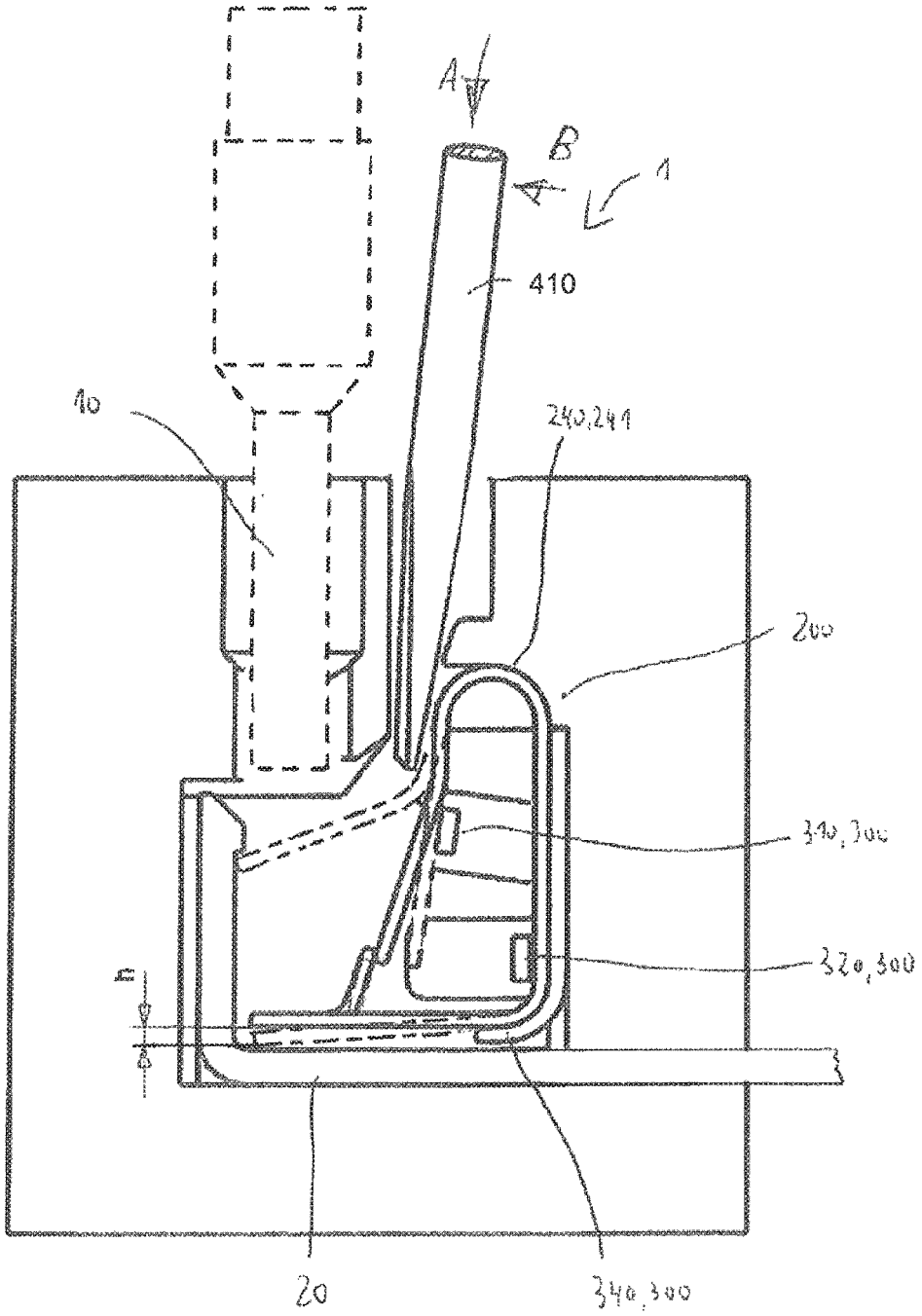
FIG. 1C is a schematic view of a third embodiment of a contacting device for contacting an electrical conductor to an electrical conductor track.
Figure 6:
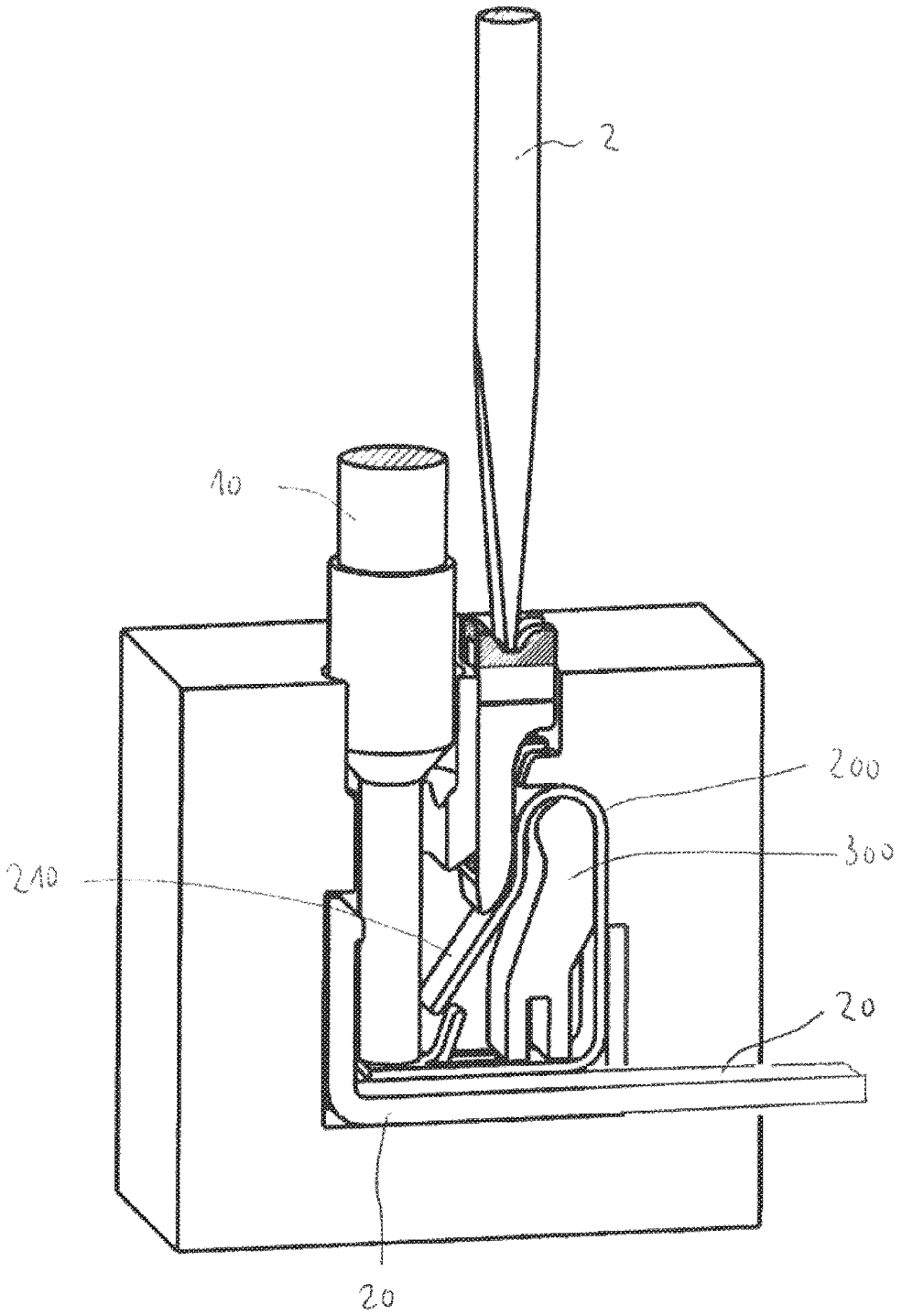
FIG. 6 is a simplified view of a contacting device for contacting an electrical conductor to an electrical conductor track when the electrical conductor is released from the press fit.

FIG. 6 illustrates how the electrical conductor 10 is released from the press fit by pushing the actuation element 400 down in the opening 103 in the housing 100 using a suitable tool 2. The actuation element 400 is used to move the first portion 210 of the contact clip 200 counter to the restoring force of the contact clip. For this purpose, the actuation element 400 is moved downward toward the cavity 104 inside the housing by the tool 2 in the third opening 103 in the housing 100. Alternatively, and as shown in FIG. 1C, the electrical conductor 10 can also be released from the press fit directly by the tool 410. This can be achieved by displacement in direction A and/or a lever movement in direction B by means of the tool 410.

In the various embodiments having and not having an actuation element 400, tools 2 and 410 can be the same tool or different tools.

Figure 7A:
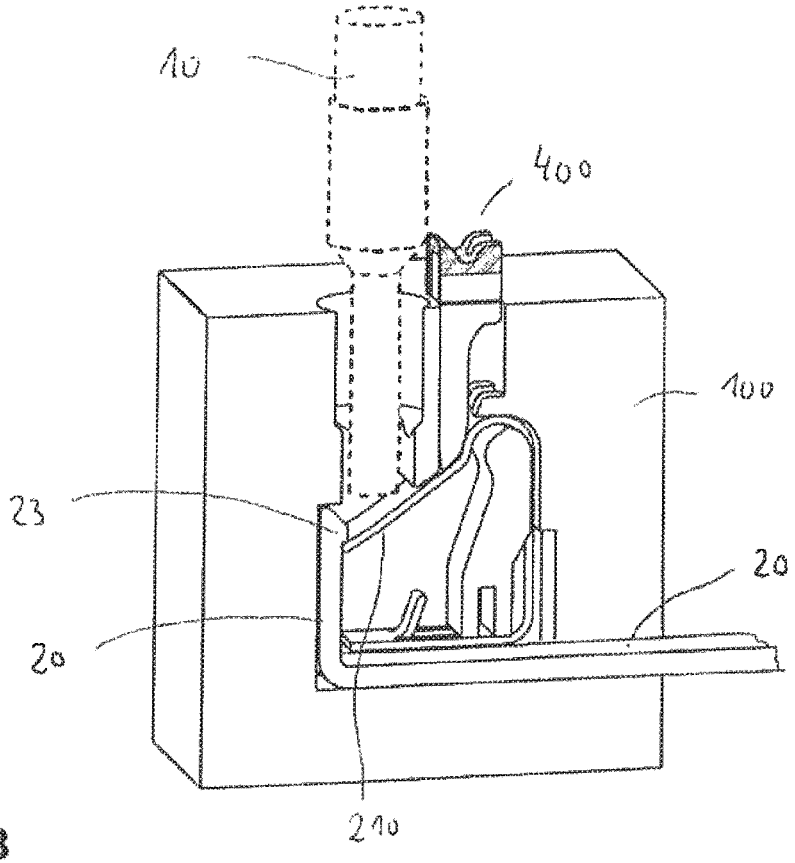
FIG. 7A is a simplified view of a contacting device for contacting an electrical conductor to an electrical conductor track in a final state after the electrical conductor has been removed from the contacting device.
Figure 7B:
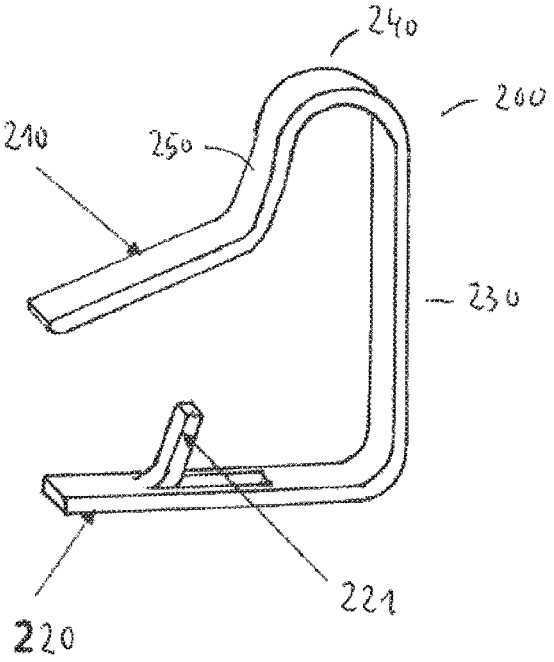
FIG. 7B shows a contact clip of the contacting device in a relaxed final state.

After the electrical conductor 10 is released from the press fit and removed from the cavity 104 inside the housing, the first portion 210 of the contact clip 200 is deflected toward the first opening 101 in the housing by the bending stress. The portion 210 of the contact clip is deflected as far as until the end 211 abuts the protrusion 23 on the second portion 22 of the conductor track 20, which protrusion is formed as a cam. Owing to the movement of the first portion 210 of the contact clip, the actuation element 400 is moved further upward in the third opening 103 in the housing until the line marking on the actuation element is visible from the outside. This position of the actuation element 400 shows an operator that the contact clip 200 is in the relaxed final state. FIG. 7B shows the contact clip 200 having the first portion 210 in its end position after the electrical conductor 10 has been removed from the cavity 104 inside the housing.

Figure 8:
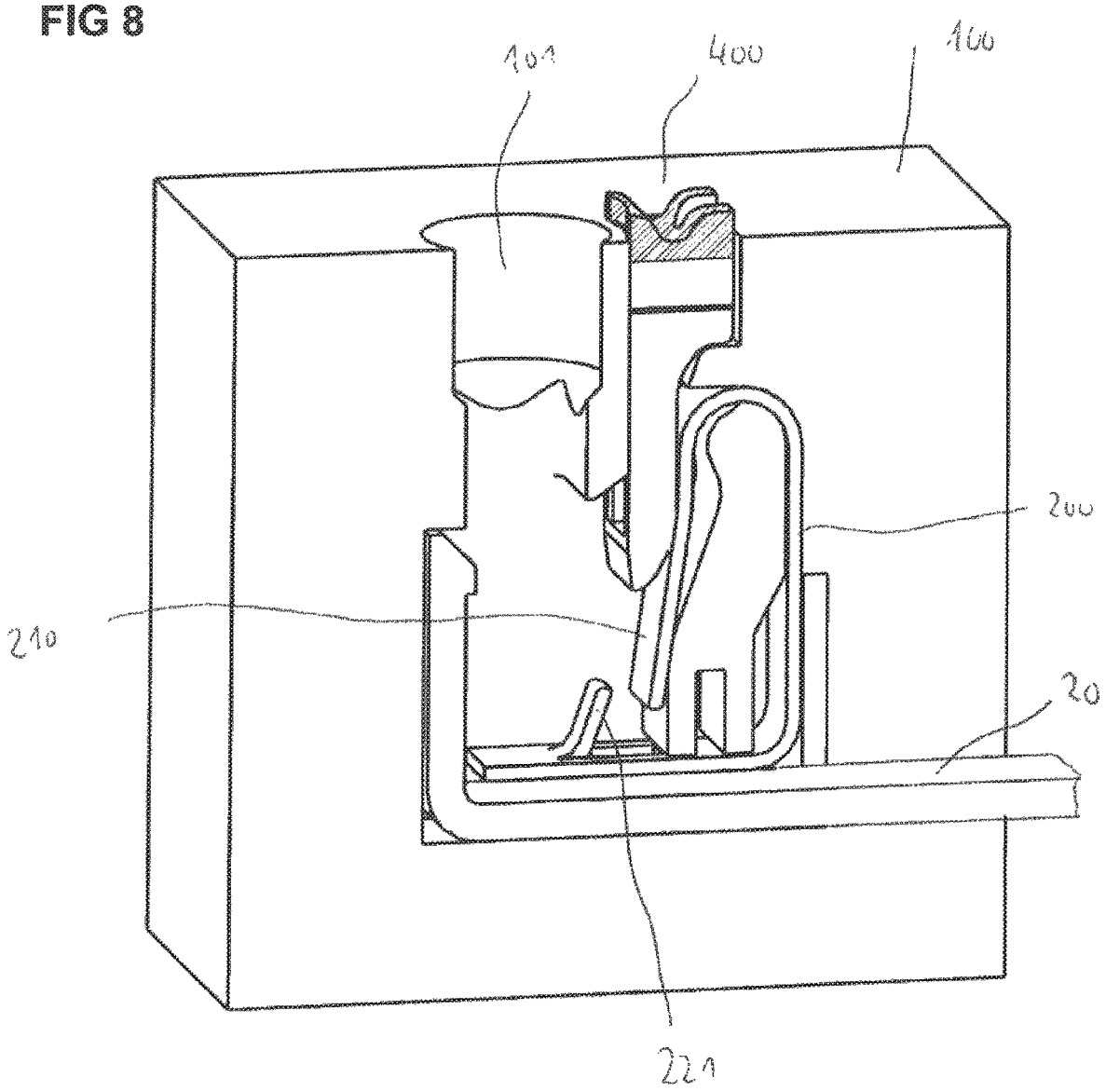
FIG. 8 is a simplified view of a contacting device for contacting an electrical conductor to an electrical conductor track when the contact clip is returned to the latched starting position.

FIG. 8 illustrates the movement of the spring-loaded leg 210 of the contact clip back into the latched starting position after the electrical conductor is removed from the opening 101 in the housing. By pushing the actuation element 400 into the cavity 104 inside the housing, the portion 210 of the contact clip is latched back into its starting position on the material protrusion 221. As already shown in FIG. 1C, this can alternatively also be done without an actuation element by directly using a tool.

Figure 9A:
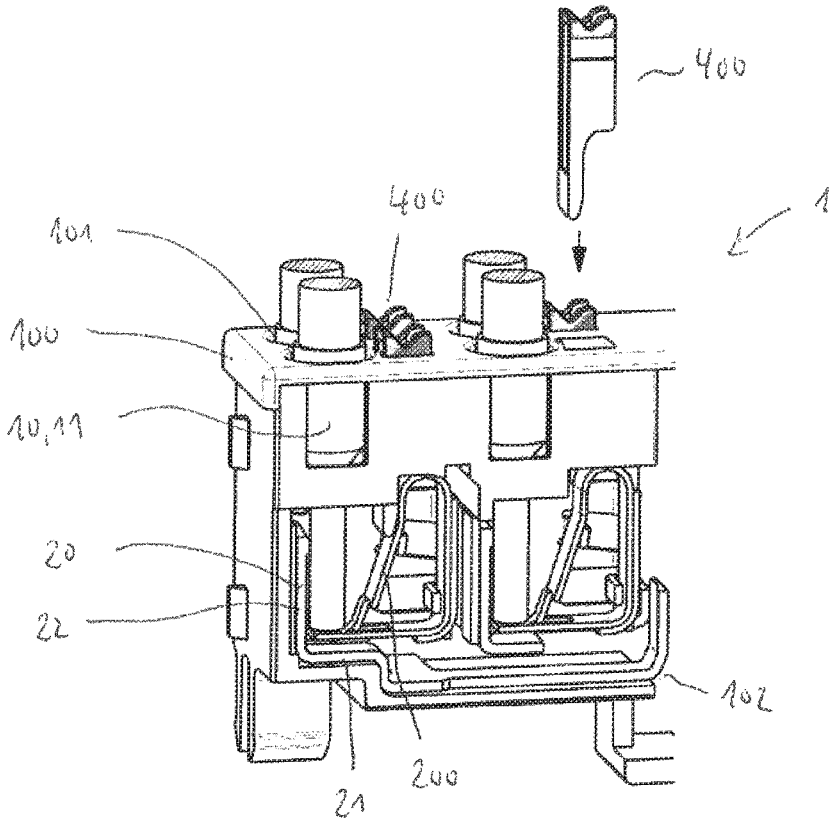
FIGS. 9A and 9B are a cross section and a plan view, respectively, of another embodiment of a contacting device for contacting an electrical conductor to an electrical conductor track.
Figure 9B:
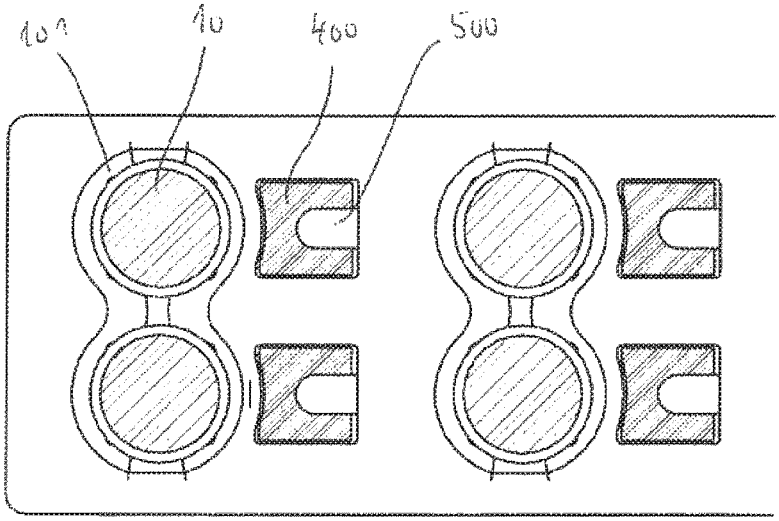

FIGS. 9A and 9B are a cross section and a plan view, respectively, of a possible embodiment of the contacting device 1 for contacting the electrical conductor 10 to the electrical conductor track 20. The contacting device can be designed, for example, as a terminal block comprising a plurality of cavities 104 having contact clips 200 arranged therein. On top, the contacting device 1 comprises a plurality of first openings 101 for inserting electrical conductors 10 into respective cavities 104 inside the contacting device. The actuation element 400 can comprise a recess 500. This makes it possible to insert a contact connection of a voltage tester into the cavity 104 and bring it in contact with the contact clip 200. The electrical conductor track 20 can be designed as a busbar that is connected to an apparatus (not shown) such as a relay. The electrical conductor track 20 is inserted into the cavity 104 inside the housing 100 through the second opening 102 in the housing 100 of the contacting device.

An embodiment of the present invention provides a contacting device (1) for contacting an electrical conductor (10) to an electrical conductor path (20), which includes a contact clip (200) arranged in a hollow space (104) of a housing (100) of the contacting device (1). In an initial state, one end (211) of the first section (210) of the contact clip is held on a material protrusion (221). The contact clip (200) is designed in such a way that, during insertion of the electrical conductor (10) into the hollow space (104) of the housing, a second section (220) of the contact clip is pressed down, whereby the end (211) of the first section (210) of the contact clip is released from the engaged position of the initial state and secures the electrical conductor (10) in the clamping position on the electrical conductor path (20).

REFERENCE NUMERALS

The following is a list of reference numerals used herein:

1 contacting device;
2 tool;
10 electrical conductor;
11 wire end ferrule;
20 electrical conductor track/busbar;
21 first portion of the electrical conductor track/busbar;
22 second portion of the electrical conductor track/busbar;
23 protrusion/cam;
100 housing;
101 first opening in the housing;
102 second opening in the housing;
103 third opening in the housing;
104 cavity;
105 bottom surface;
200 contact clip;
210 first portion of the contact clip;
211 end of the first portion of the contact clip;
220 second portion of the contact clip;
221 material protrusion/lug;
230 third portion of the contact clip;
240 fourth portion of the contact clip;
241 bent region of the contact clip;
250 fifth portion of the contact clip;
300 guide element;
310 stop;
320 contact surface;
330 contact surface;
340 bearing surface;
400 actuation element;
410 tool; and
500 recess in the actuation element.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A contacting device for contacting an electrical conductor to an electrical conductor track, the contacting device comprising:

a housing having a first opening configured to receive the electrical conductor into a cavity inside the housing, and a second opening configured to receive the electrical conductor track into the cavity inside the housing; and a contact clip arranged in the cavity inside the housing, wherein the contact clip comprises a single element comprising a first portion having an end configured to press the electrical conductor onto the electrical conductor track, and a second portion from which a material protrusion of the contact clip protrudes, the material protrusion being integrated in the second portion, wherein the contact clip is configured to be bent in the cavity in such a way that the first portion is under bending stress and the end of the first portion of the contact clip is pressed against the material protrusion by the bending stress, wherein the second portion of the contact clip is arranged below the first opening in the housing perpendicularly to a longitudinal direction of the first opening and in parallel with a bottom surface of the cavity, wherein the second portion of the contact clip is movably arranged in the housing such that the second portion of the contact clip and the material protrusion are displaceable when a force acts on the second portion of the contact clip, as a result of which the end of the first portion of the contact clip is released from abutting the material protrusion and is pressed against the electrical conductor owing to the bending stress on the first portion of the contact clip such that the electrical conductor is held on the electrical conductor track in a press fit when the electrical conductor is inserted into the contacting device through the first opening and the electrical conductor track is inserted into the contacting device through the second opening, wherein the contacting device further comprises a guide element that is arranged in the cavity inside the housing and is configured to guide the contact clip such that the first portion of the contact clip is under the bending stress, wherein the second portion of the contact clip is arranged in the housing perpendicularly to the longitudinal direction of the first opening in the housing at a distance above the bottom surface of the cavity, wherein the contact clip comprises a third portion that is arranged in the housing perpendicularly to the second portion of the contact clip, and wherein the guide element comprises a first contact surface which the third portion of the contact clip abuts.

2. The contacting device according to claim 1, wherein the guide element comprises a stop for limiting a movement of the first portion of the contact clip between the stop and the material protrusion on the contact clip, and wherein the stop of the guide element is arranged in the cavity in such a position that the bending stress on the first portion of the contact clip is greater when the first portion of the contact clip abuts the stop than when it abuts the material protrusion on the contact clip.

3. The contacting device according to claim 1, wherein the contact clip comprises a fourth portion adjoining the third portion of the contact clip, wherein the fourth portion of the contact clip has a bent region, and wherein the guide element has a second contact surface on which the bent region of the fourth portion of the contact clip rests.

4. The contacting device according to claim 1, wherein the guide element comprises a bearing surface on which the second portion of the contact clip rests, and wherein the bearing surface of the guide element is arranged on an end of the second portion of the contact clip at which the second portion merges into the third portion of the contact clip.

5. The contacting device according to claim 1, wherein the guide element is a metal frame arranged in the cavity inside the housing or is integrally molded as a contour of the housing.

6. The contacting device according to claim 1, wherein the material protrusion is a lug for latching the end of the first portion of the contact clip and the lug is bent out of the plane of the second portion of the contact clip.

7. A contacting device for contacting an electrical conductor to an electrical conductor track, the contacting device comprising:

a housing having a first opening configured to receive the electrical conductor into a cavity inside the housing, and a second opening configured to receive the electrical conductor track into the cavity inside the housing; and a contact clip arranged in the cavity inside the housing, wherein the contact clip comprises a single element comprising a first portion having an end configured to press the electrical conductor onto the electrical conductor track, and a second portion from which a material protrusion of the contact clip protrudes, the material protrusion being integrated in the second portion, wherein the contact clip is configured to be bent in the cavity in such a way that the first portion is under bending stress and the end of the first portion of the contact clip is pressed against the material protrusion by the bending stress, wherein the second portion of the contact clip is arranged below the first opening in the housing perpendicularly to a longitudinal direction of the first opening and in parallel with a bottom surface of the cavity, and wherein the second portion of the contact clip is movably arranged in the housing such that the second portion of the contact clip and the material protrusion are displaceable when a force acts on the second portion of the contact clip, as a result of which the end of the first portion of the contact clip is released from abutting the material protrusion and is pressed against the electrical conductor owing to the bending stress on the first portion of the contact clip such that the electrical conductor is held on the electrical conductor track in a press fit when the electrical conductor is inserted into the contacting device through the first opening and the electrical conductor track is inserted into the contacting device through the second opening, the contacting device further comprising an actuation element for moving the first portion of the contact clip counter to the restoring force of the contact clip, wherein the housing comprises a third opening for receiving the actuation element, and wherein the contacting device is configured such that the electrical conductor can be released from the press fit when the actuation element in the third opening in the housing is moved downward toward the cavity inside the housing.

8. The contacting device according to claim 7, wherein the first portion of the contact clip is a spring-loaded leg which is configured such that, when the electrical conductor is removed from the first opening in the housing, it is deflected toward the first opening in the housing.

9. The contacting device according to claim 8, wherein the actuation element rests on the first portion of the contact clip in the cavity inside the housing, and wherein the actuation element is moved upward in the third opening in the housing depending on the movement of the first portion of the contact clip.

10. The contacting device according to claim 7 is configured such that the electrical conductor is released from the press fit by the actuation element being moved downward toward the cavity inside the housing.

* * * * *